US005181412A

United States Patent [19]

Lisec

[11] Patent Number: 5,181,412

[45] Date of Patent: Jan. 26, 1993

[54] APPARATUS BENDING HOLLOW PROFILES INTO SPACER FRAMES FOR INSULATING GLASS

[76] Inventor: Peter Lisec, Bahnhofstrasse 34, A-3363 Amstetten-Hausmening, Austria

[21] Appl. No.: 677,581

[22] Filed: Mar. 29, 1991

[30] Foreign Application Priority Data

Mar. 30, 1990 [AT] Austria ..... 742/90
Sep. 10, 1990 [AT] Austria ..... 1840/90

[51] Int. Cl.[5] ..... B21D 7/00; B21D 43/10

[52] U.S. Cl. ..... 72/307; 72/422; 226/158; 226/162

[58] Field of Search ..... 72/307, 217, 422; 226/158, 162, 163, 147-151

[56] References Cited

U.S. PATENT DOCUMENTS

| | | | |
|---|---|---|---|
| 463,935 | 11/1891 | Blackburn | 226/151 |
| 3,286,500 | 11/1966 | Weiss | 72/217 |
| 3,299,681 | 1/1967 | Hautau . | |
| 3,586,226 | 6/1971 | Nippert | 226/149 |
| 3,844,461 | 10/1974 | Robison | 226/162 |
| 4,161,110 | 7/1979 | Ritter et al. . | |
| 4,350,033 | 9/1982 | Ishihara | 72/217 |
| 4,580,711 | 4/1986 | Iimura | 226/158 |
| 4,590,779 | 5/1986 | Stange et al. . | |
| 4,681,210 | 7/1987 | Miki | 72/307 |
| 4,848,120 | 7/1989 | Schwarze | 72/149 |

FOREIGN PATENT DOCUMENTS

| | | | |
|---|---|---|---|
| 410094 | 1/1991 | European Pat. Off. | 72/422 |
| 1772812 | 8/1958 | Fed. Rep. of Germany . | |
| 3221986 | 12/1983 | Fed. Rep. of Germany . | |
| 8705796 | 7/1987 | Fed. Rep. of Germany . | |
| 2428728 | 1/1980 | France . | |
| 2553314 | 4/1985 | France | 72/307 |
| 638273 | 9/1983 | Switzerland . | |
| 342708 | 6/1972 | U.S.S.R. | 72/422 |

OTHER PUBLICATIONS

"Absolut-digitale Eindeutigkeit", *Maschinenmarkt Industriejournal*, vol. 77, 1971, by H. Herholz, pp. 1923-1927.

*Primary Examiner*—Daniel C. Crane
*Attorney, Agent, or Firm*—Young & Thompson

[57] ABSTRACT

Apparatus for bending hollow profiles 3 into spacer frames for insulating glass panes, the hollow profile 3 being advanced by a gripper 2 displaceable along a conveyor 4. The magnitude of the stepwise advance of the hollow profile 3 corresponds to the lengths of the legs of the spacer frame to be made. A pickup 6 on the gripper 2 measures precisely each stepwise advance.

8 Claims, 3 Drawing Sheets

APPARATUS BENDING HOLLOW PROFILES INTO SPACER FRAMES FOR INSULATING GLASS

The invention concerns apparatus for bending shaped sections, or hollow profiles, into spacer frames for insulating glass panes and comprising a bending system and a conveyor to move the hollow profile.

Such apparatus is known for example from the German Gebrauchsmuster 87 05 796.4 or the German Offenlegungsschrift 32 21 986. In such known apparatus, the length of the hollow profile or section projecting beyond the bending station must be determined in order that the spacer frame be obtained with the desired dimensions.

The known bending systems for making spacer frames for insulating glass determine the length of the shaped section by measuring the path with an incremental pickup.

As a rule the shaped section is moved by conveying rollers on each side of it, at least one of them being driven. A wheel, ie a pickup wheel, rolls on the outer wall of the shaped section so moved and is frictionally connected by the shaft or another drive to an incremental pickup.

The pickup wheel running along the outer wall of the shaped section, i.e. the hollow profile, senses the magnitude of the advance of the channel.

Such apparatus incurs the drawback that the frictional connection between the pickup wheel and the shaped section or hollow profile is uneven and accordingly more or less pronounced slippage takes place. Different material surfaces of the hollow channel—rough or smooth—but also residues of dust or metal chips unfailingly cause defective measurement by the incremental pickup, most of all when the channel is stopped during the measurement motion or is just entering the zone of the pickup wheel.

The Swiss patent 638,273 discloses a device for forming insulating bars into metal shaped sections to be combined into a composite channel. The jaws described in the Swiss patent 638,273 placed against an insulating bar serve to hold it in place before metal hollow profiles are slipped onto it. The jaws so align the insulating bar that it then is possible to slip the hollow profiles onto it. The Swiss patent 638,273 no more effects a longitudinal motion of the insulating bar by means of the jaws than it mentions a motion in the longitudinal direction of the jaws 26 placed against the insulating bar.

As regards the bending system known from the German Gebrauchsmuster 87 05 796.4, a pair of rollers is provided to displace the hollow profile. The rollers cannot be displaced in the longitudinal direction of the hollow profile.

Again conveying rollers are used in the German Offenlegungsschrift 32 21 986 which are mounted in fixed manner in the machine frame with respect to the direction of conveyance and are used to advance the hollow profile.

In view of the drawbacks of the known measurement systems, the object of the invention is to create apparatus allowing accurate measurement, without tolerances, of the distance covered by the hollow profile when being moved into a bending system, that is, the magnitude of the advance of the hollow profile.

This problem is solved by the invention by apparatus characterized in that it comprises a gripper which can be affixed to the hollow profile and which is displaceable parallel to the direction of conveyance by a preselectable distance.

By means of the apparatus of the invention, the hollow profile which shall be bent into a spacer frame is advanced by the gripper prior to each bending procedure precisely by that distance which corresponds to the length of the particular leg of the spacer frame. If the leg length is larger than the maximum excursion of the gripper, the hollow profile shall be advanced in two, or, where called for, more than two steps. This procedure may be such that the first stroke(s) correspond(s) to a predetermined length (for instance the maximum stroke) and the last stroke is matched to the length of the frame leg.

A practical embodiment mode of the apparatus of the invention is characterized in that the gripper is present on a carriage displaceable on a guide which is parallel to the direction of conveyance.

The magnitude of the gripper-carriage movement and hence of the advance of the hollow profile can be determined in especially accurate and economical manner provided that a distance-measuring system, for instance an incremental pickup, is associated with the carriage.

As a practical matter, it is preferred that the carriage be coupled with an endless toothed belt driven by a drive motor. Thereby the drive is easily made slippage-free. Alternatively the drive motor may be mounted on the carriage and be fitted with a pinion meshing with a gear-rack stationary inside the apparatus.

The procedure is simplified if a stop means which can be lowered below the conveyor is provided.

Further details and features of the invention are listed in the following description of an embodiment mode shown in the drawing.

Figure 1:
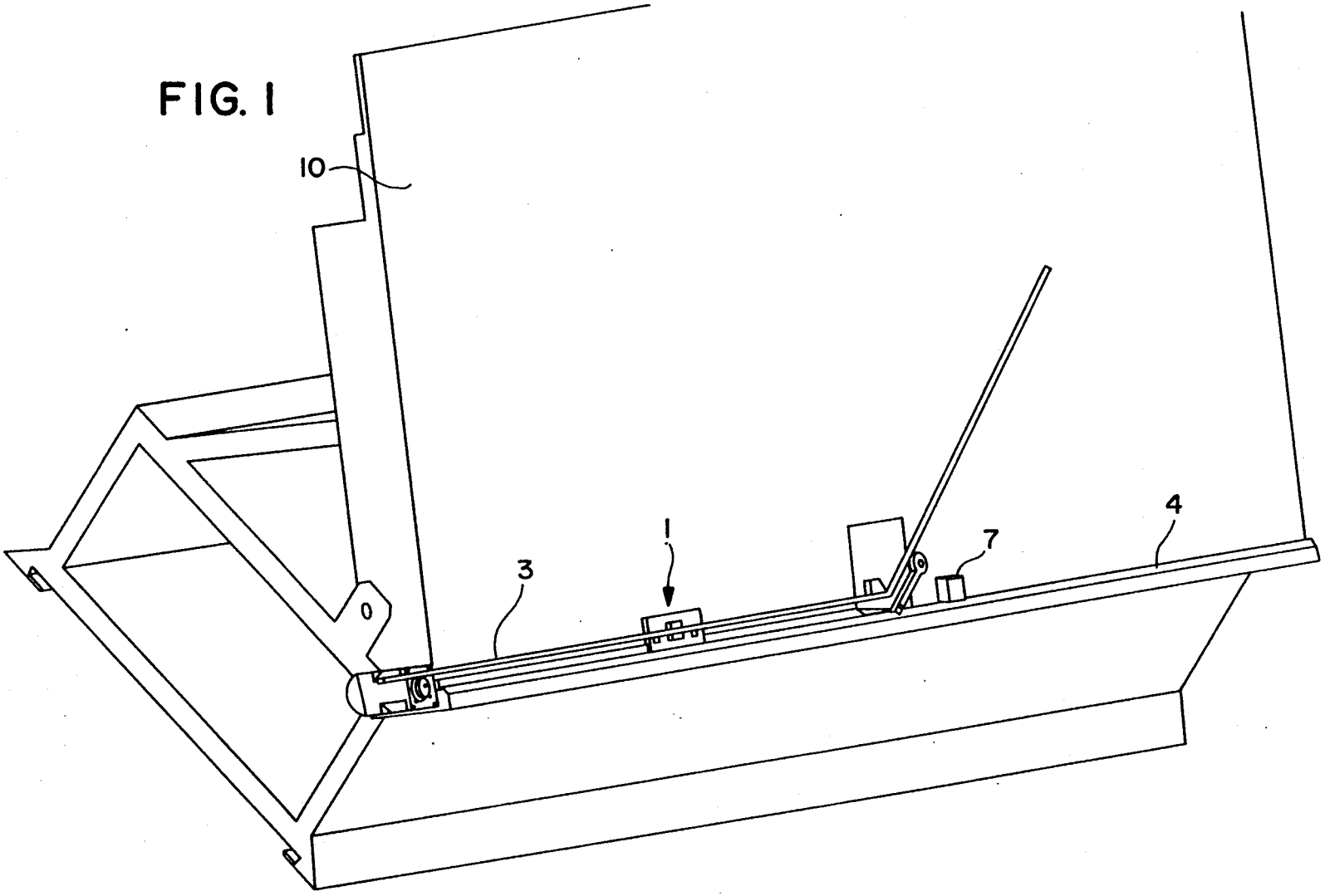
FIG. 1 shows apparatus for bending channels into spacer frames.
Figure 2:
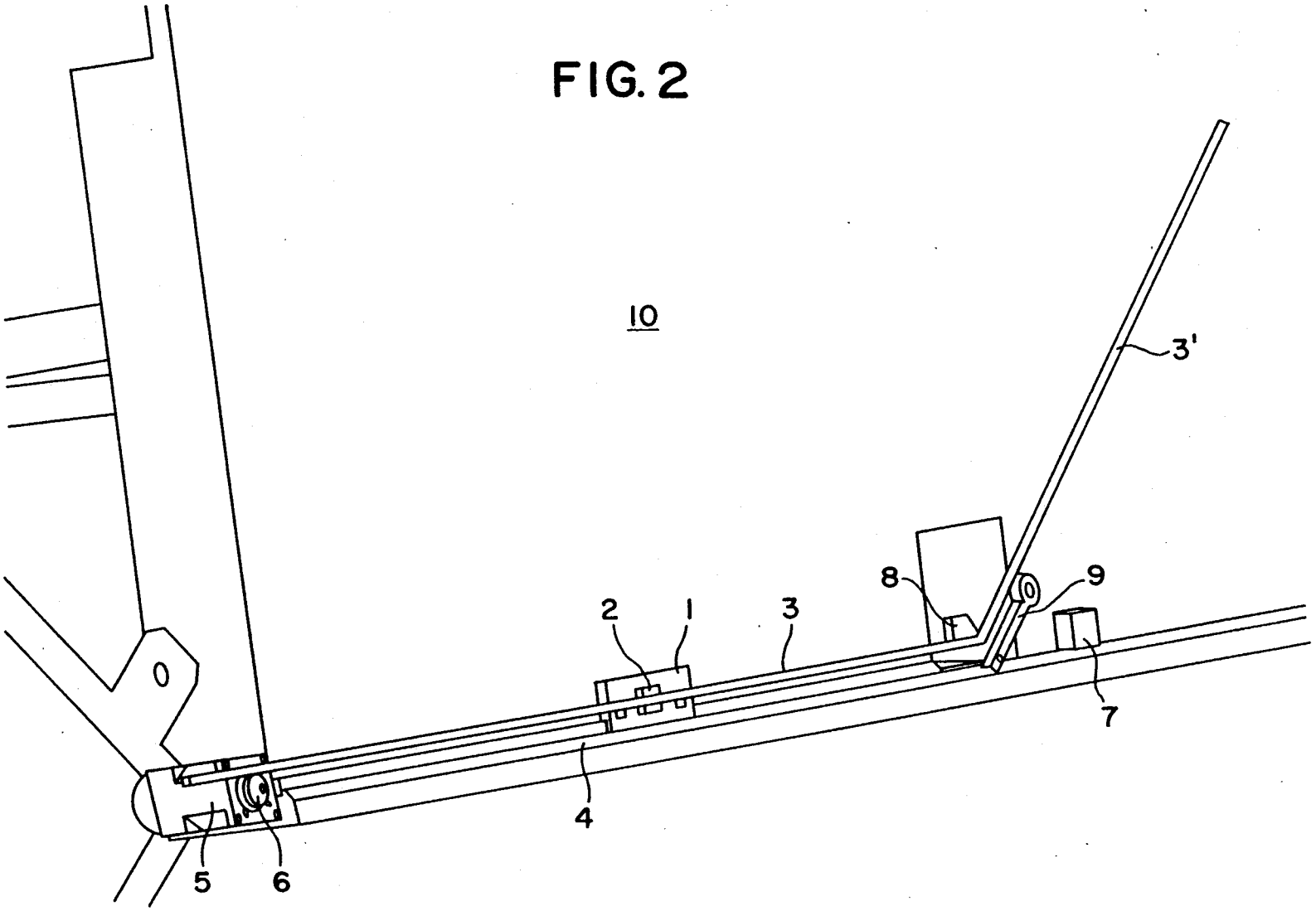
FIG. 2 is the apparatus of FIG. 1 on a larger scale.

A hollow profile 3 is moved by a conveyor 4 mounted on the lower end of a support wall 10 and illustratively is an endless conveyor belt or a mere slide path, as far as a stop 7 in the vicinity of a bending station consisting of a bending rest 8 and a bending lever 9 which can be pivoted in order to bend the hollow profile 3.

As described in further detail below, the segment 3' of the hollow profile 3 moved beyond the bending station 8/9 is bent while resting on the support wall 10 by the bending lever 9 around a rest 8.

Moreover the apparatus may evince the design known from the German Gebrauchsmuster 87 05 796 and comprise a support stud adjustable up and down in the support wall 10 which it crosses, in the manner too in which it is disclosed in the known apparatus of the German Gebrauchsmuster 87 05 796.

The hollow profile 3 is advanced by the conveyor 4 along the lower edge of wall 10 as far as the limit stop 7. Thereby the hollow profile 3 is located in a "null" position with zero tolerance. Thereupon the jaws of gripper 2 mounted on the carriage 1 seize the hollow profile 3 when in such position. The limit stop 7 is lowered below the conveyance track 4 and next the carriage 1 together with the hollow profile 3 clamped by the gripper 2 advances toward the bending lever 9 precisely by that distance which is preset by a process-control computer and which corresponds to the length of the frame leg minus the distance from rest 8 to stop 7. Once the carriage 1 arrives at the preset and actually measured end point of its motion, the bending lever 9 will bend the segment 3' of the hollow profile 3 projecting beyond the carriage 1, this segment being moved upward along the rearward slanting support wall 10 by an angle preset by the process-control computer.

The accurate measurement of the distance moved by the carriage 1 is ascertained by an incremental pickup 6, i.e., the distance the carriage 1 moves and hence the size of the advance of the hollow profile 3 is controlled by it. The incremental pickup 6 is mounted on the drive motor 5 or at another point along the conveyance track 4 of the carriage 1.

The carriage 1 is driven by an endless toothed belt and is guided on a guide parallel to the conveyance track 4.

The toothed belt meshes precisely and without play with the drive gear of the geared drive motor 5, so that even an incremental pickup 6 directly mounted on the motor-gear unit can accurately record the path covered by the carriage 1. The distance the carriage 1 must actually cover corresponds to the length of the segment 3' of the hollow profile 3, which is determined by the process-control computer and which corresponds to the length of one leg of the spacer frame to be made from the hollow profile 3, again minus the distance from 8 to 7 when 7 initially stops hollow profile 3.

A gear-rack mounted on the conveyor track of the carriage also is advantageous in driving the carriage 1. In this alternative system, the drive motor 5 need not be stationary on the bending bench 10, rather it may also be mounted on the carriage 1. The drive gear of the geared drive motor 5 in that case meshes with the gear-rack affixed to the conveyance track 4, and again an incremental pickup 6 may be mounted on the drive motor 5 or on the carriage 1.

While the bending lever 9 bends the segment 3' of the hollow profile 3 upward, the gripper 2 mounted on the carriage 1 detaches from the hollow profile 3. Thereupon the carriage 1 returns at high speed to its initial position and the gripper 2 again seizes in friction-locking manner the hollow profile 3. After the bending lever 9 has been pivoted back, the carriage 1 again can be displaced in the direction of the bending lever 9 precisely by the path preset by the process-control computer and displace correspondingly the hollow profile 3.

If the hollow profile 3 is guided by a guide means preceding the apparatus as far as the stop 7, then the guide track 4 may be a simple slide path.

At least one of the following features is essential to the invention:

A guide means parallel to the hollow profile-conveyance plane of the rearward slanting support wall 10 and in the lower horizontal plane, a conveyor means moving on this guide means, with sensing of the path covered.

At least one gripper 2 mounted on the displaceable carriage 1 driven in slip-free manner by a drive means 5 (geared motor) and seizing the hollow profile 3 in friction-locking manner. The carriage/gripper unit ½ moves the hollow profile 3 toward the bending lever 9. An incremental pickup 6 mounted on the drive motor 5 or on the conveyor carriage 1 in geometric manner locks a conveyor belt or meshes with a gear rack and detects the path covered by the carriage 1 and preset by a process-control computer.

After the limit switchover point has been reached, that is once the hollow profile 3 has been advanced a distance corresponding to the length of the frame leg by the carriage 1 which holds it by its gripper 2, the bending lever 9 presses the segment 3' of the hollow profile 3 against the bending rest (or bending cheek) to such a height as was determined by the process-control computer for the angle in the corner to be bent for the spacer frame being manufactured.

While the bending lever 9 is bending the segment 3' of the hollow profile 3 upward about the bending rest 8 by the preset angle and along the rearward slanting support wall 10, the gripper 2 opens and the carriage returns to its initial position, whereafter the gripper 2 closes again and retains the hollow profile 3 in friction-locking manner. Thereupon the carriage 1 again advances in relation to the preset distance toward the bending station 8/9 and the next corner now can be bent.

Figure 3:
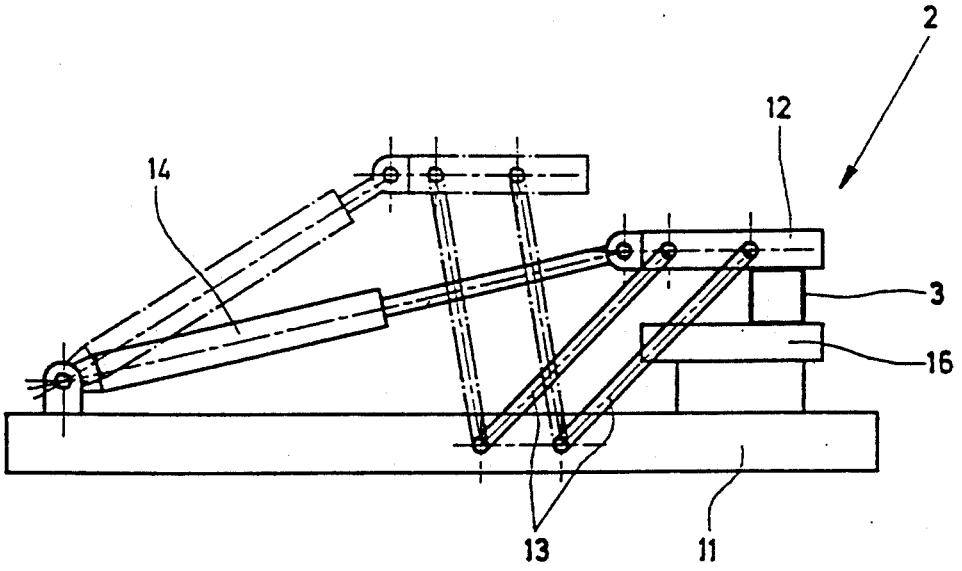
FIG. 3 is an embodiment of an advancing system.

FIG. 3 shows an especially advantageous embodiment of a gripper 2 assuring the frictional locking required for the precise advance of the hollow profile 3. It is clear that the lower jaw 16 is rigidly joined with a carriage 11 guided in the direction of advance by at least one guide rail (not shown), whereas the upper jaw 12 can be pivoted by means of a parallelogram system 13 and a pressurized-medium actuator 14 away from the jaw 16. The movable jaw 12 can be pivoted to the rear of the support wall 10 of the apparatus so that it shall not hamper the evacuation of a finished spacer frame.

What is claimed is:

1. In apparatus for bending hollow polygonal profiles (3) into spacer frames for insulating glass panes, comprising a bending system (8, 9) and a conveyor (4) to move the hollow profile (3); the improvement comprising only a single gripper (2) in said apparatus, said single gripper being adapted to be releasably secured to the hollow profile (3) and which both moves by a pre-selected distance parallel to the conveyor (4) and releases the hollow profile (3) during a bending operation, whereby said single gripper (2) grips the hollow profile (3) not only during advance of the hollow profile into a bending position but also during the onset of bending, and an incremental pickup (6) disposed on said apparatus for measuring said pre-selected distance of displacement of said single gripper (2).

2. Apparatus defined in claim 1, wherein he gripper (2) is present on a carriage (1) which can be displaced on a guide means parallel to the conveyor (4).

3. Apparatus defined in claim 2, wherein the carriage (1) is driven by an endless toothed belt driven by a drive motor (5).

4. Apparatus defined in claim 1, and a stop (7) which can be lowered below the conveyor (4) and is present in the vicinity of the bending system (8/9).

5. Apparatus defined in claim 1, wherein the gripper (2) is displaceable to-and-fro on a carriage (1, 11) parallel to the conveyance direction of the hollow profile (3) and, during its stroke toward the bending system (8/9), engages the hollow profile (3).

6. Apparatus defined in claim 1, wherein the gripper (2) comprises jaws (12, 16) which can be applied at the top and from below to the hollow profile (3).

7. Apparatus defined in claim 6, wherein the lower jaw (16) of the gripper (2) is fixed to the carriage (11) and the upper jaw (12) of the gripper (2) is displaceably mounted on the carriage (11).

8. Apparatus defined in claim 7, wherein the displaceable jaw (12) is joined by a parallelogram system (13) to the carriage (11).

* * * * *